US011679297B1

(12) United States Patent
Davis

(10) Patent No.: US 11,679,297 B1
(45) Date of Patent: Jun. 20, 2023

(54) EXERCISE APPARATUS WITH A SLIDABLE PLATFORM FOR RESISTANCE EXERCISES

(71) Applicant: Justin Davis, Mableton, GA (US)

(72) Inventor: Justin Davis, Mableton, GA (US)

( * ) Notice: Subject to any disclaimer, the term of this patent is extended or adjusted under 35 U.S.C. 154(b) by 43 days.

(21) Appl. No.: 17/336,952

(22) Filed: Jun. 2, 2021

Related U.S. Application Data

(60) Provisional application No. 63/033,323, filed on Jun. 2, 2020.

(51) Int. Cl.
*A63B 21/00* (2006.01)
*A63B 21/062* (2006.01)
*A63B 21/04* (2006.01)

(52) U.S. Cl.
CPC ..... *A63B 21/4045* (2015.10); *A63B 21/0428* (2013.01); *A63B 21/0628* (2015.10); *A63B 21/154* (2013.01); *A63B 21/4035* (2015.10); *A63B 21/4039* (2015.10)

(58) Field of Classification Search
CPC ..... A63B 21/0428; A63B 21/0628; A63B 21/154; A63B 21/4035; A63B 21/4039; A63B 21/4045; A63B 22/0076; A63B 22/0087; A63B 22/0089; A63B 22/14; A63B 22/20; A63B 22/201; A63B 22/203; A63B 2022/0079
See application file for complete search history.

(56) References Cited

U.S. PATENT DOCUMENTS 4,618,139 A * 10/1986 Haaheim ..... A63B 22/0012 482/131
5,295,935 A * 3/1994 Wang ..... A63B 21/4033 482/130
5,383,831 A * 1/1995 Drath ..... A63B 23/0405 482/145
8,721,510 B2 * 5/2014 Chung-Ting ..... A63B 22/205 482/142
9,022,909 B2 * 5/2015 Kermath ..... A63B 21/0428 482/133
9,283,422 B2 * 3/2016 Lagree ..... A63B 21/0557
10,478,663 B2 * 11/2019 Lagree ..... A63B 21/157
2013/0090211 A1 * 4/2013 Campanaro ..... A63B 23/03525 482/4
2013/0095981 A1 * 4/2013 Chung-Ting ..... A63B 22/205 482/66

(Continued)

*Primary Examiner* — Loan B Jimenez
*Assistant Examiner* — Zachary T Moore
(74) *Attorney, Agent, or Firm* — Barry Choobin; Patent 360

(57) ABSTRACT

An exercise including a horizontal rail having a proximal end and a distal end. The rail is supported at a height by two or more vertical supports at the proximal end and distal end. A fixed member is positioned at the proximal end of the rail and have a pair of handles and a pair of arm support, wherein the positions of the pair of handles correspond to the positions of the two arm supports. The exercise apparatus includes a slide member slidably mounted to the rail and slide between the distal end and the fixed member. A user can kneel on the slide member while gripping the two handles and having the arms supported by the two arm supports. Once in position, the user can pull the slider member towards the fixed member against the resistance of a resistance mechanism.

20 Claims, 14 Drawing Sheets

(56) References Cited

U.S. PATENT DOCUMENTS

| | | | | |
|---|---|---|---|---|
| 2014/0011645 | A1* | 1/2014 | Johnson | A63B 23/03525 482/121 |
| 2014/0121076 | A1* | 5/2014 | Lagree | A63B 22/0089 482/123 |
| 2016/0059061 | A1* | 3/2016 | Lagree | A63B 21/4035 482/92 |
| 2017/0113091 | A1* | 4/2017 | Lagree | A63B 21/4034 |
| 2017/0246497 | A1* | 8/2017 | Barsøe | A63B 21/0557 |
| 2022/0023714 | A1* | 1/2022 | Holman | A63B 22/203 |

* cited by examiner

EXERCISE APPARATUS WITH A SLIDABLE PLATFORM FOR RESISTANCE EXERCISES

CROSS-REFERENCE TO RELATED APPLICATIONS

This application claims priority from the U.S. provisional patent application Ser. No. 63/033,323, filed on Jun. 2, 2020, which is incorporated herein by reference in its entirety.

FIELD OF THE INVENTION

The present invention relates to an exercise apparatus, and more particularly, the present invention relates to an exercise apparatus for strength training and a method of use thereof.

BACKGROUND

Prior art is rich in different types of fitness equipment. The fitness equipment having slidable weight assembly is also known for strength and muscle building. Multiple weight bars that can be increased or decreased in number are mounted to a frame that allows guided vertical movement of the weight bars during exercise. A user works against the resistance offered by slidable weights which hastens muscle building. Fitness equipment is designed with a focus on training certain muscle groups. However, the known weight fitness equipment generally is similar in designs and provides limited body workouts.

A desire is there for an exercise apparatus that provides an improved body workout and minimizes any chance of injury.

Following terms are used hereinafter to explain the structure and functioning of the disclosed exercise apparatus.

C-Channel: As used in this disclosure, the C-channel is a structure that is formed in a U-shape. The C-channel forms a prism shape with a hollow interior and an open lateral face that forms a shape characteristic of the letter C when viewed from the congruent ends. The open space of the C-channel is often used as a track. A C-channel is a U-shaped structure.

Cant: As used in this disclosure, a cant is an angular deviation from one or more reference lines (or planes) such as a vertical line (or plane) or a horizontal line (or plane).

Center Axis: As used in this disclosure, the center axis is the axis of a cylinder or a prism.

The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two-cylinder, prism, or pyramidal structures share the same line they are said to be aligned. When the center axes of two-cylinder, prism, or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures is joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and 2) the first object can superimpose over the second object such that the first object aligns, within manufacturing tolerances, with the second object.

Cord: As used in this disclosure, a cord is a long, thin, flexible, and prism-shaped string, line, rope, or wire. Cords are made from yarns, piles, or strands of material that are braided or twisted together or from a monofilament (such as a fishing line). Cords have tensile strength but are too flexible to provide compressive strength and are not suitable for use in pushing objects. String, line, cable, and rope are synonyms for the cord.

Coronal Direction: As used in this disclosure, the coronal direction is a direction that runs between the lateral surfaces surface of an object and that is perpendicular to the sagittal direction and the transverse direction.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Distal: As used in this disclosure, distal refers to a directional sense or location of an object. Specifically, distal refers to a first object or a side of a first object, that is distal from the medial axis, or more proximal to the side of the object, relative to a second object, or side of a second object.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or inelastic material.

Elastic Nature: As used in this disclosure, an elastic nature refers to a flexible structure that returns to its relaxed shape after the flexible structure has been deformed.

Elevation: As used in this disclosure, elevation refers to the span of the distance in the superior direction between a specified horizontal surface and a reference horizontal surface. Unless the context of the disclosure suggests otherwise, the specified horizontal surface is the supporting surface the potential embodiment of the disclosure rests on. The infinitive form of elevation is to elevate.

Extension Apparatus: As used in this disclosure, an extension apparatus is a mechanical structure that is used to extend or bridge the reach between any two objects.

Exterior: As used in this disclosure, the exterior is used as a relational term that implies that an object is not contained within the boundary of a structure or space.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares the first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inelastic Nature: As used in this disclosure, an inelastic nature refers to a flexible structure that maintains its new shape after the flexible structure has been deformed.

Inferior: As used in this disclosure, the term inferior refers to a directional reference that is parallel to and in the same direction as the force of gravity when an object is positioned or used normally.

Inner Dimension: As used in this disclosure, the term inner dimension describes the span from a first inside or interior surface of a container to a second inside or interior surface of a container. The term is used in much the same way that a plumber would refer to the inner diameter of a pipe.

Interior: As used in this disclosure, the interior is used as a relational term that implies that an object is contained within the boundary of a structure or space.

Lateral: As used in this disclosure, the term lateral refers to an axis of an object that is perpendicular in the sagittal and the transverse direction.

Lateral Disk Structure: As used in this disclosure, a lateral plate structure refers to the juxtaposition of a first lateral face of a first disk-shaped structure to a second lateral face of a second disk-shaped structure such that: a) the center axes of the first disk and the second disk are parallel; and, b) the congruent ends of the first disk are parallel to the congruent ends of the second disk. The span of the length of the center axes of the first disk and the second disk need not be equal. The form factor of the congruent ends of the first disk and the second disk need not be geometrically similar.

Lateral Prism Structure: As used in this disclosure, a lateral prism structure refers to the juxtaposition of a first lateral face of a first prism structure to a second lateral face of a second prism structure such that: a) the center axes of the first prism and the second prism are parallel; and b) the congruent ends of the first prism are parallel to the congruent ends of the second prism. The span of the length of the center axes of the first prism and the second prism need not be equal. The form factor of the congruent ends of the first prism and the second prism need not be geometrically similar.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Lock: As used in this disclosure, a lock is a fastening device that secures a rotating mechanical device into a fixed position.

Medial: As used in this disclosure, medial refers to a directional sense or location of an object. Specifically, medial refers to a first object or a side of a first object that is closer to the medial axis or more distal from the side of the object relative to a second object or side of a second object.

Medial Axis: As used in this disclosure, the medial axis is the centerline of an object that is parallel to the sagittal direction. When two objects are compared relative to the medial axis, the object closer to the medial axis is referred to as the medial object and the object distal from the medial axis is referred to as the lateral object.

Negative Space: As used in this disclosure, negative space is a method of defining an object through the use of open or empty space as the definition of the object itself, or, through the use of open or empty space to describe the boundaries of an object.

Offset Lateral Prism Structure: As used in this disclosure, an offset lateral disk structure refers to the juxtaposition of a first lateral face of a first disk structure to a second lateral face of a second disk structure in the manner of a lateral disk structure except that one or more of the following conditions need not be true: a) the center axes of the first prism and the second prism are no longer parallel; and, b) the congruent ends of the first prism are no longer parallel to the congruent ends of the second prism.

Offset Lateral Prism Structure: As used in this disclosure, an offset lateral prism structure refers to the juxtaposition of a first lateral face of a first prism structure to a second lateral face of a second prism structure in the manner of a lateral prism structure except that one or more of the following conditions need not be true: a) the center axes of the first prism and the second prism are no longer parallel; and, b) the congruent ends of the first prism are no longer parallel to the congruent ends of the second prism.

One-to-One: When used in this disclosure, a one-to-one relationship means that a first element selected from a first set is in some manner connected to only one element of a second set. A one-to-one correspondence means that the one-to-one relationship exists both from the first set to the second set and from the second set to the first set. A one-to-one fashion means that the one-to-one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pedestal: As used in this disclosure, a pedestal is an intermediary load-bearing structure that forms a load path between two objects or structures.

Perimeter: As used in this disclosure, a perimeter is one or more curved or straight lines that bound an enclosed area on a plane or surface. The perimeter of a circle is commonly referred to as circumference.

Posterior: As used in this disclosure, posterior is a term that is used to refer to the side of an object that is distal or in the opposite direction of the anterior side. When comparing two items, the posterior item is the item that is distal from the anterior of the object.

Primary Shape: As used in this disclosure, the primary shape refers to a description of the overall geometric shape of an object that is formed from multiple components.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when the further description is required, a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pulley: As used in this disclosure a pulley is a wheel with a grooved rim around which a cord (or other form of rope, line, or cable) passes. The pulley is used to change the direction of a force applied to the cord.

Rail: As used in this disclosure, a rail is a continuous structure that forms a path that is used to guide the motion of an object.

Reach: As used in this disclosure, reach refers to a span of distance between any two objects.

Relaxed Shape: As used in this disclosure, a structure is considered to be in its relaxed state when no shear, strain, or torsional forces are being applied to the structure.

Rigid Structure: As used in this disclosure, a rigid structure is a solid structure formed from an inelastic material that resists changes in shape. A rigid structure will permanently deform as it fails under a force. See bimodal flexible structure.

Sagittal Direction: As used in this disclosure, the sagittal direction runs from the superior surface to the inferior surface of an object and is perpendicular to the coronal direction and the transverse direction.

Slewing Bearing: As used in this disclosure, a clewing bearing is a device that is used to rotate an object on a horizontal surface. Slewing bearings are typically load bearing structures Slewing bearings are often called turntable bearings or a lazy Susan bearing.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Stanchion: As used in this disclosure, a stanchion refers to a vertically oriented prism-shaped pole, post, or support.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Telescopic: As used in this disclosure, telescopic is an adjective that describes a composite prism structure made of hollow prism-shaped sections that fit or slide into each other such that the composite prism structure can be made longer or shorter by adjusting the relative positions of the hollow prism-shaped sections.

Track: As used in this disclosure, a track is a physical structural relationship between a first object and a second object that serves a purpose selected from the group consisting of: 1) fastening the second object to the first object; 2) controlling the path of motion of the first object relative to the second object in at least one dimension and in a maximum of two dimensions; or, 3) a combination of the first two elements of this group.

SUMMARY OF INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to an exercise apparatus for strength training of the body.

It is another object of the present invention that the exercise apparatus provides a more effective body workout for abdominal muscles, arms, and thighs.

It is still another object of the present invention that the exercise apparatus can be adapted to available space in a room.

It is a further object of the present invention that the exercise apparatus is safer in use.

In one aspect, disclosed is an exercise apparatus for stretching and strength-building exercises against variable resistance. The exercise apparatus includes a horizontal rail having a proximal end and a distal end. The rail is supported at a height by two or more vertical supports at the proximal end and distal end. A fixed member is positioned at the proximal end of the rail. The fixed member can have a pair of handles and a pair of arm support, wherein the positions of the pair of handles correspond to the positions of the two arm supports, such as a user having his arm, supported on the two arm supports can grasp the two handles with the arms and hands straight. The exercise apparatus further includes a slide member slidably mounted to the rail such as the rail can guide the movement of the slide member between the distal end and the fixed member.

In one aspect, the slide member can be configured to support a user in a kneeling position, wherein the shin portion of the leg below the knee rest against the top surface of the slide member. The top surface of the slide member can be configured to provide comfortable support for the legs and prevent slippage. The slide member and the fixed member are configured such as a user can kneel on the slide member while grasping the two handles and having the arms rested on the two arm supports. Moreover, the user can pull and push the slide member towards and away from the fixed member.

In one aspect, the exercise apparatus includes a resistance mechanism that provides a counterforce against the horizontal forward motion of the slide member towards the fixed member. Additionally, the resistance member can pull the slider using the stored potential energy away from the fixed member.

In one aspect, the resistance mechanism can be a resistance band. Alternatively, the resistance mechanism can be a vertical slide weight assembly connected to the slide member through a cord. The vertical slide weight assembly can be positioned adjacent to the distal end of the horizontal rail and in line with the length of the horizontal rail. Alternatively, the weight bar assembly can be positioned on either left or right side of the horizontal rail. In such a case, a diverter having a pulley can be used to route the cord from the vertical slide weight assembly to the slide member.

In one aspect, the height of the fixed member relative to the height of the rail or the slide member can be increased or decreased. Additionally, the fixed member can be tilted forwards and rearwards to adjust to the different requirements of the user. Similarly, the slider can also tilt in forward, rearward, and sidewards directions. Additionally, the slider can be tilted left and right sides for oblique physical training activities.

In one aspect, disclosed is a method of using the exercise apparatus for strength training. A user can kneel on the slide member and bend forward to grasp both the handles. Thereafter, the arms can be settled on the arm support of the fixed member. The user can then use the combined strength of muscles of the body, in particular, of the abdomen, arms, and legs to push the slide member towards the fixed member against the resistance. While on returning, the strength can be applied to slow down the rearward movement of the slide member, wherein the slide member is being pulled by the potential energy of the resistance mechanism. Such a to-and-fro motion can be repeated the desired number of times for the desired amount of workout.

These and other objects and advantages of the embodiments herein and the summary will become readily apparent from the following detailed description taken in conjunction with the accompanying drawings

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Figure 1:
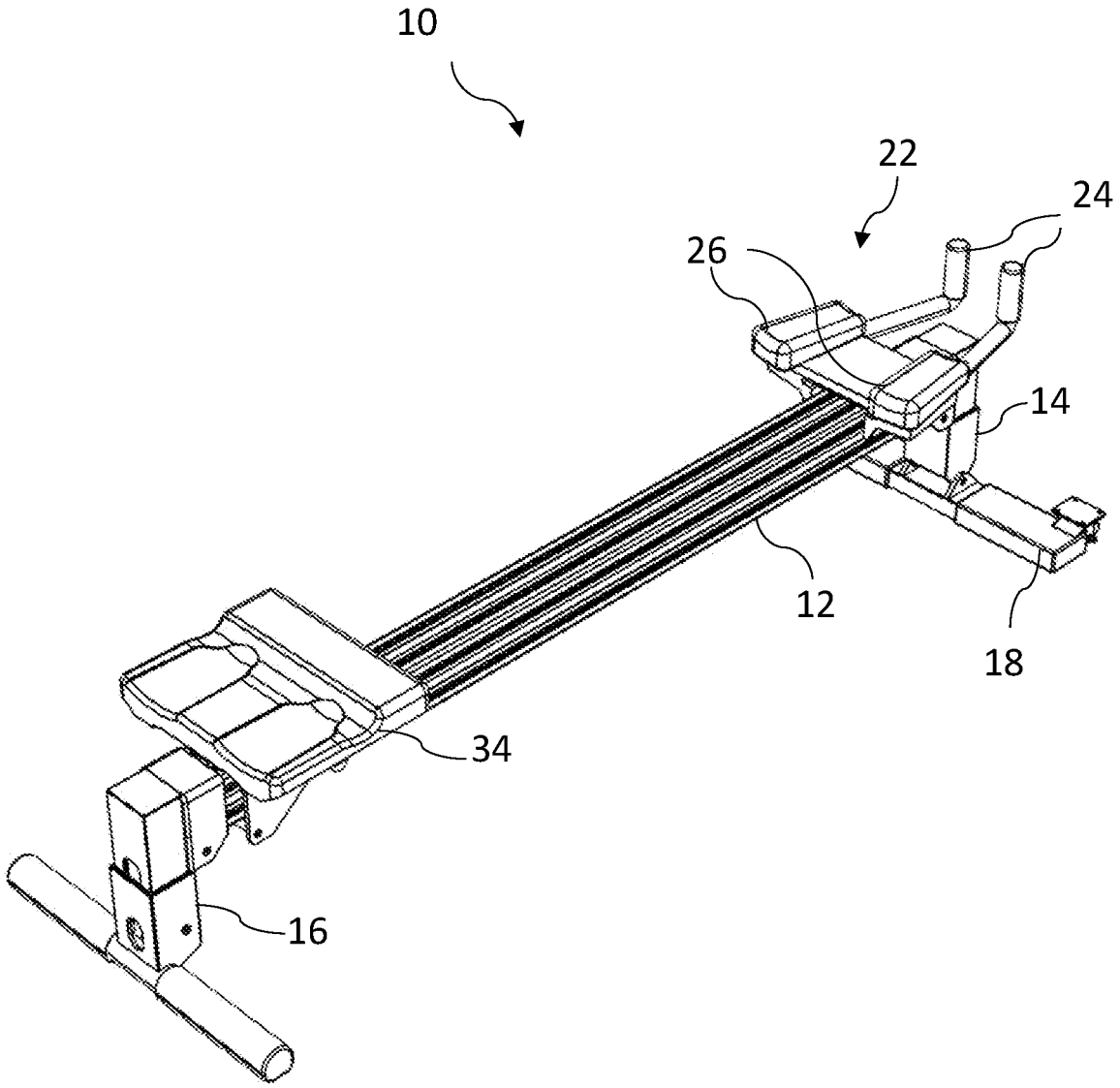
FIG. 1 is a perspective view of the exercise apparatus, according to an exemplary embodiment of the present invention.
Figure 2:
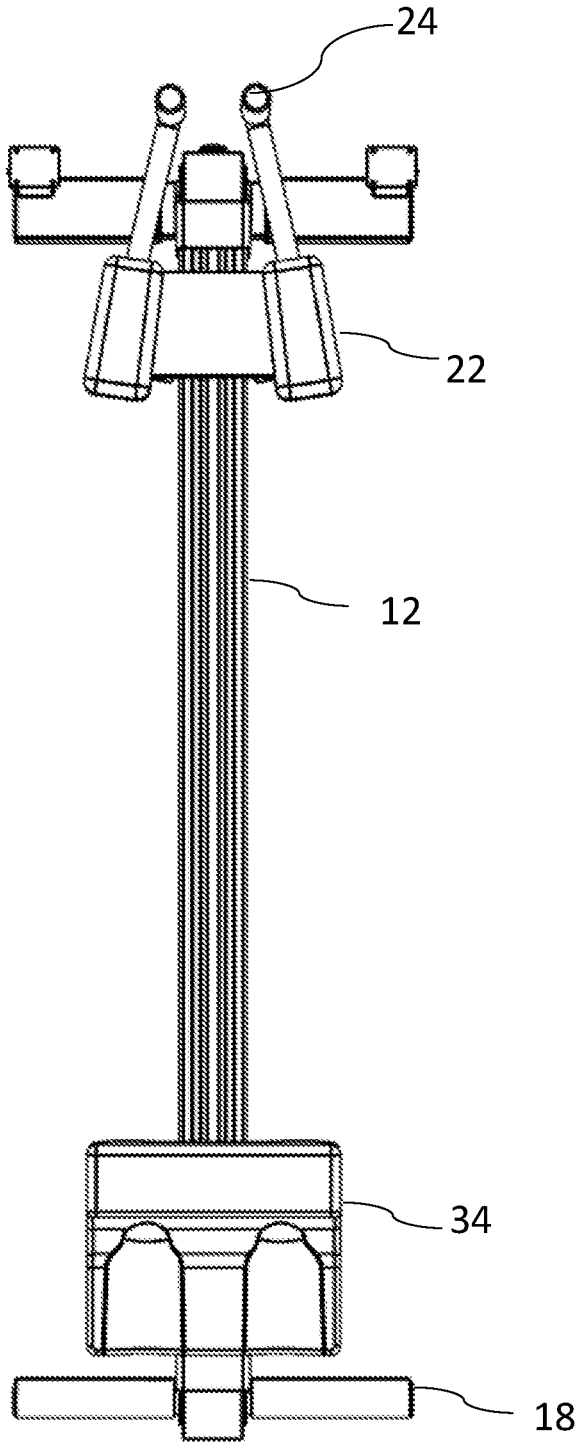
FIG. 2 is a top view of the exercise apparatus, according to an exemplary embodiment of the present invention.
Figure 3:
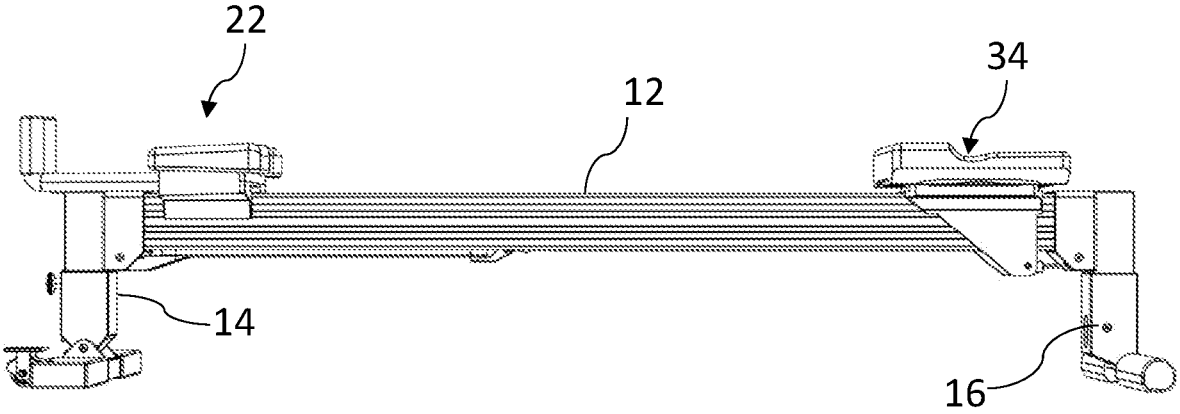
FIG. 3 is a left-side view of the exercise apparatus, according to an exemplary embodiment of the present invention.
Figure 4:
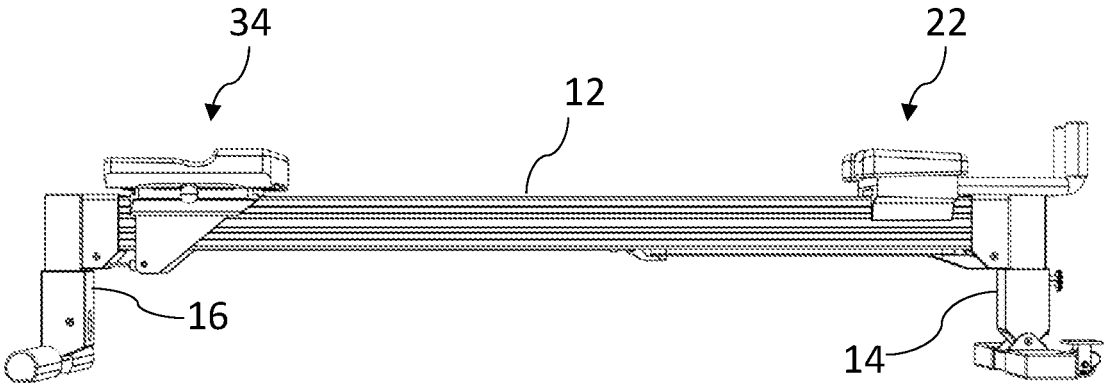
FIG. 4 is a right-side view of the exercise apparatus, according to an exemplary embodiment of the present invention.

Disclosed is an exercise apparatus for strength training against a counterforce of resistance mechanism for a full-body workout and especially exercising the abdominal muscles. Referring to FIG. 1 which shows an exemplary embodiment of the disclosed exercise apparatus 10. FIG. 1 shows a perspective view, FIG. 2 shows a top view, FIG. 3 shows a left side view, and FIG. 4 shows a right-side view of the exercise apparatus 10. The exercise apparatus 10 includes a horizontal rail 12 having a proximal end and a distal end. The horizontal rail 12 can be supported at a height above the floor by two or more stanchions. FIG. 1 shows a first stanchion 14 at the proximal end of rail 10 and a second stanchion 16 at the distal end of rail 10, wherein the first stanchion and the second stanchion support the rail 12 at the height. The two stanchions may permit to adjustment of the height of the rail above the floor. Suitable mechanisms to increase or decrease the height of vertical supports are known to a skilled person, and any such mechanism can be used to increase or decrease the height of the rail above the floor without departing from the scope of the present invention. The heights of the two stanchions can be adjusted independently of each other. Additionally, a frame can be provided to stabilize the exercise apparatus 10 on the floor while exercising. For example, FIG. 1 shows a frame 18 to which the two stanchions can be integral, welded, or coupled using fasteners for stability and strength. Each stanchion can be having two or more members, wherein the adjacent members can move relative to each other to increase or decrease the height of the stanchion. FIG. 1 shows both stanchions having two telescoping upper and lower members.

Figure 5:
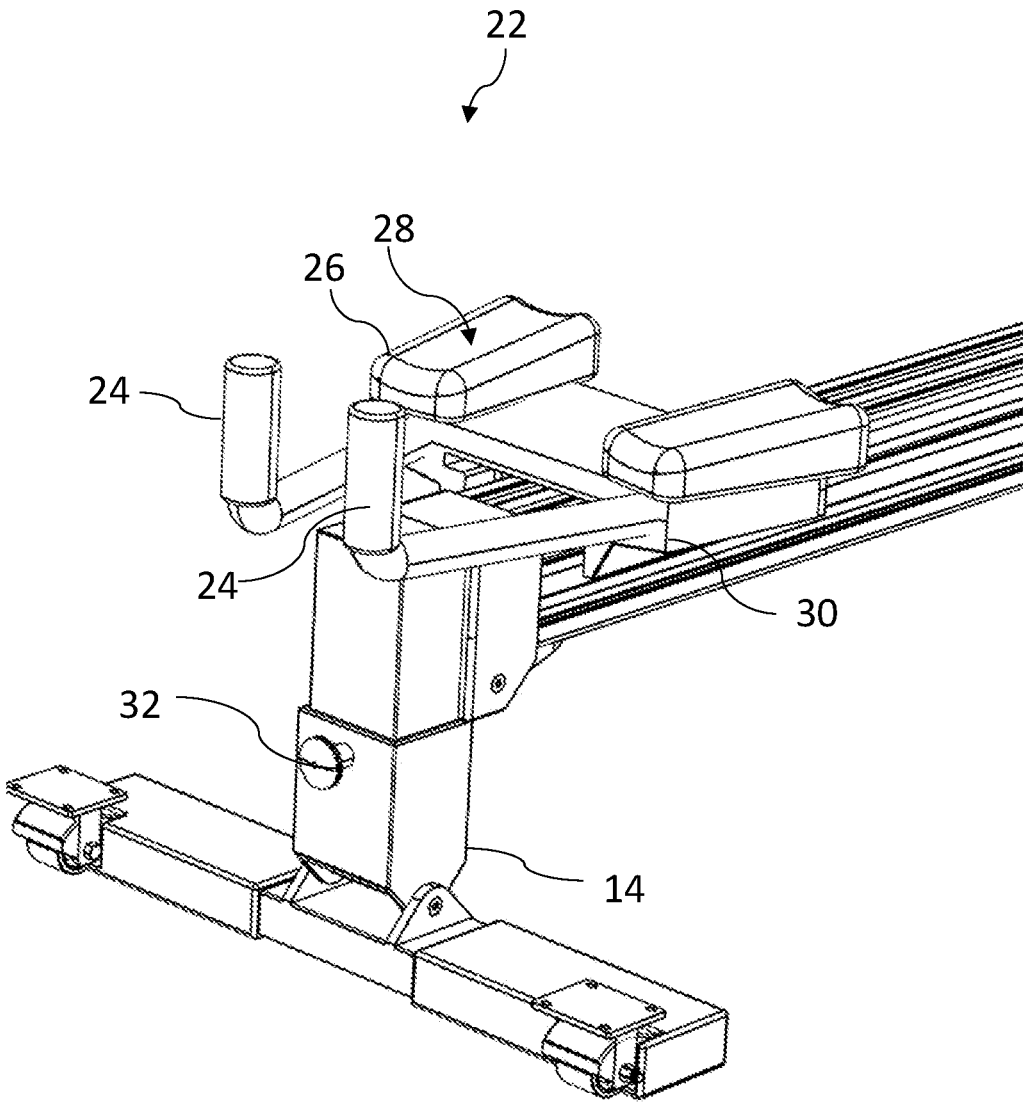
FIG. 5 is an enlarged view of a fixed member of the exercise apparatus, according to an exemplary embodiment of the present invention.

At the proximal end of the rail 12 can be coupled a fixed member 22 having a pair of handles 24 and a pair of arm support 26. The arm supports can be dimensioned such as a user can comfortably rest his arms on the arm support. As shown in FIG. 5 which is an enlarged view of the fixed member, each arm support 26 can have a depression 28 to keep the arms stationary. The concave depression can prevent the lateral movement of the arm. The handles 24 can be positioned relative to the height of the arm supports, such as the arms rested on the arm supports can grasp the handles without tilting the hands. The arms and hands can be straight while grasping the handles and the arms rested on the arm supports. The length of the handles can allow minor adjustments based on different arm sizes as well as may also allow adjusting hand position depending on the requirements of the user. The arm supports 26 and the handles 24 can be coupled to a base plate 30, wherein the base plate 30 can be coupled to the proximal end of the rail 12. Alternatively, the base plate can also be coupled to the upper member of the first stanchion 14. The fixed member 12 can be stationary relative to the rail. The height of the fixed member 22 can be adjusted relative to the height of rail 12. A knob 32 can be seen in FIG. 5, wherein turning the knob in either direction may ascend or descend the upper member of the first stanchion 14. The first stanchion 14 may include a mechanism that may permit both increasing or decreasing the height of the fixed member relative to the rail. Any such telescoping mechanism known to a skilled person for increasing and decreasing a height of an object supported on a vertical post is within the scope of the present invention. Besides the height, the tilt of the fixed member can also be adjusted relative to the rail. The fixed member 22 can be tilted both forward and rearwards thus providing freedom to the users to adjust the exercise apparatus according to their needs or requirements.

Figure 6:
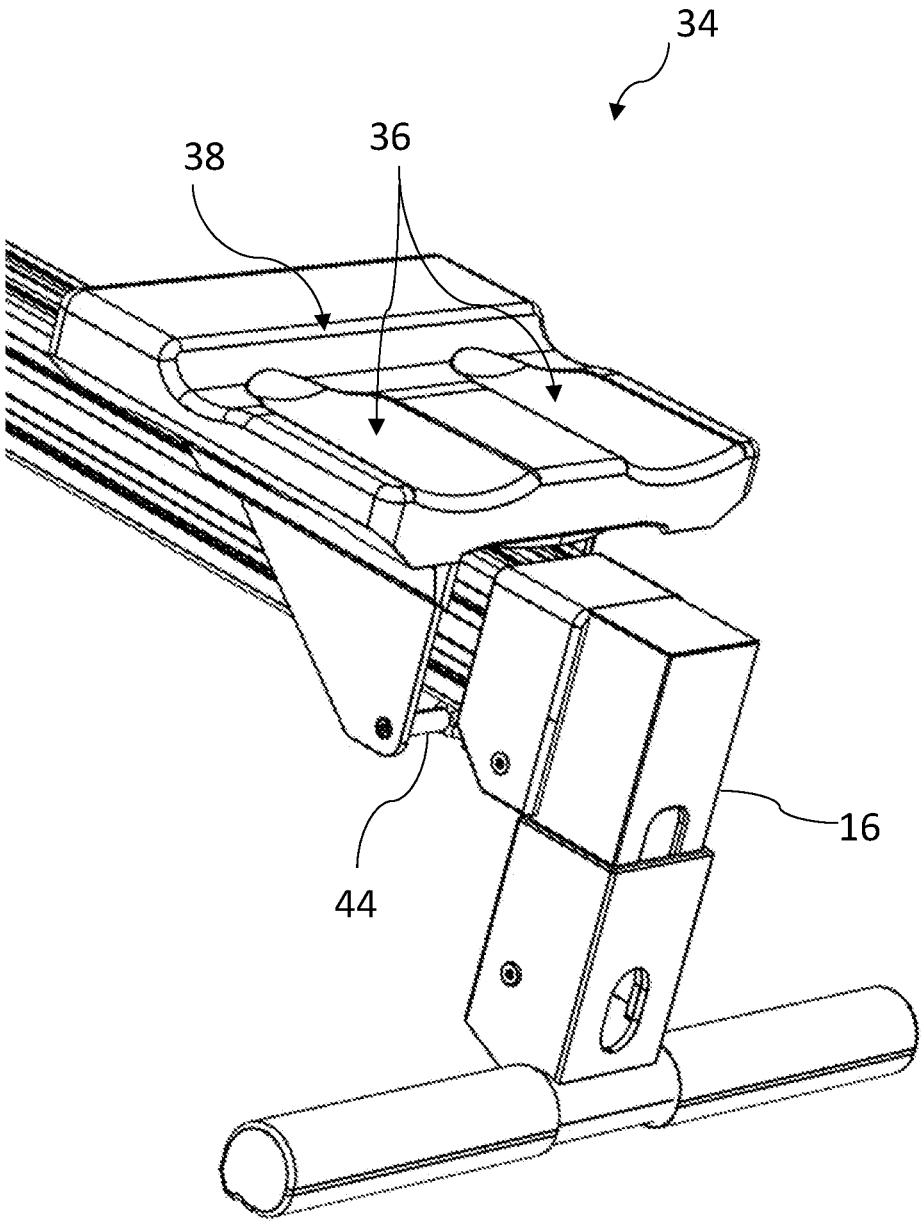
FIG. 6 is an enlarged view of a slide member of the exercise apparatus, according to an exemplary embodiment of the present invention.
Figure 7:
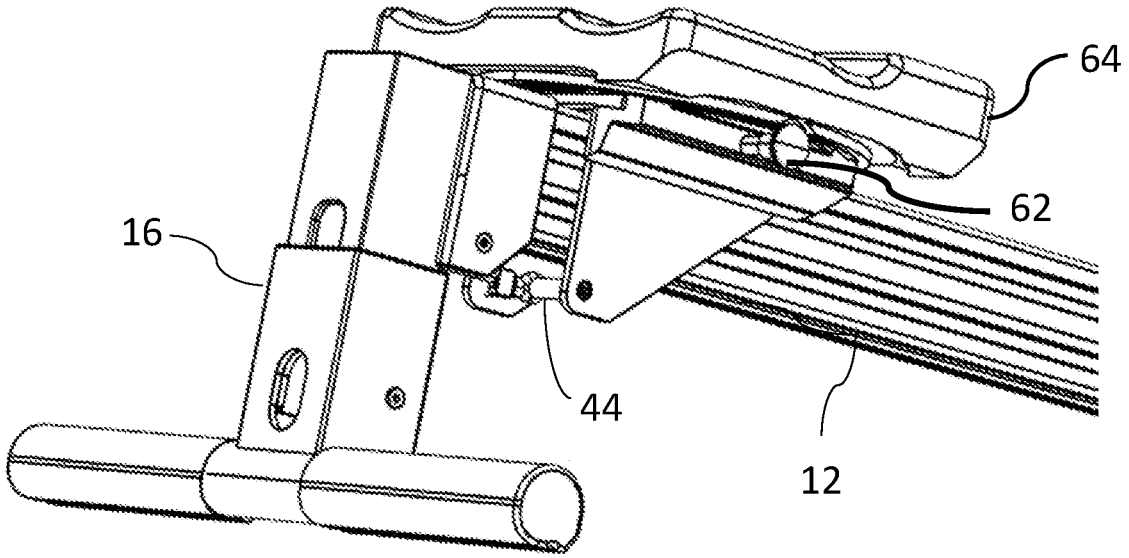
FIG. 7 is a bottom perspective view of the slide member as in FIG. 6, according to an exemplary embodiment of the present invention.
Figure 8:
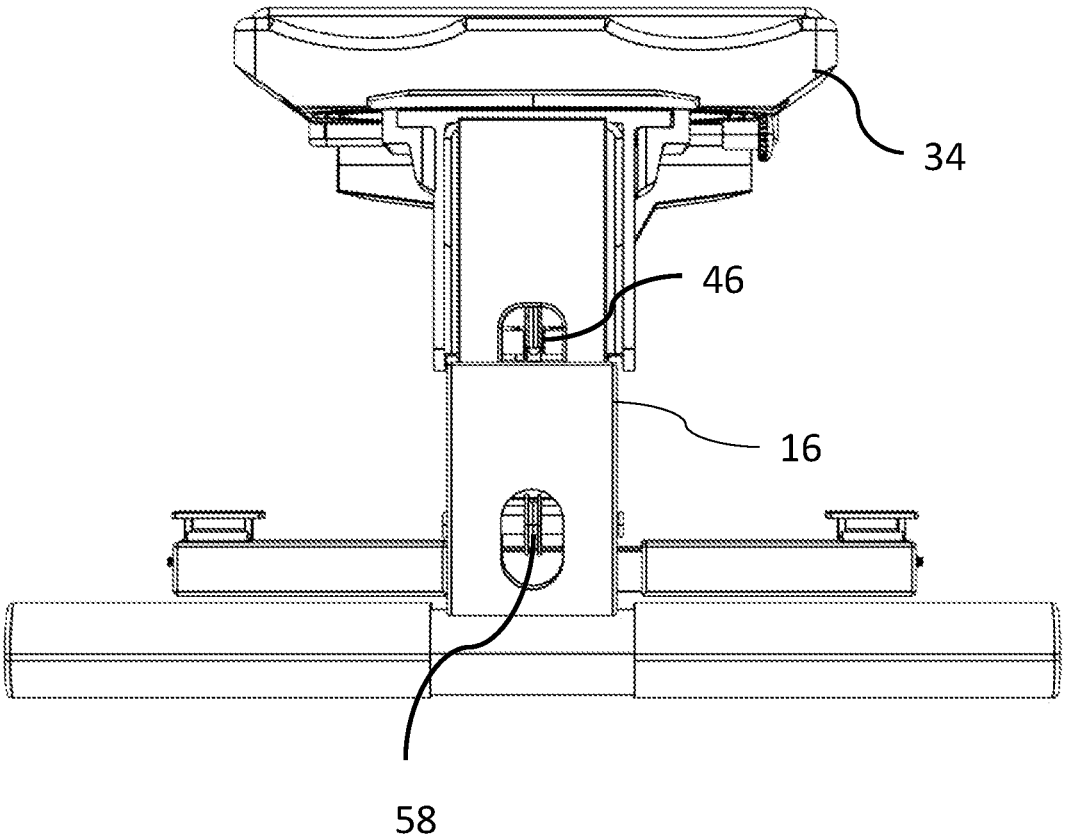
FIG. 8 is a rear view of the exercise apparatus, according to an exemplary embodiment of the present invention.
Figure 9:
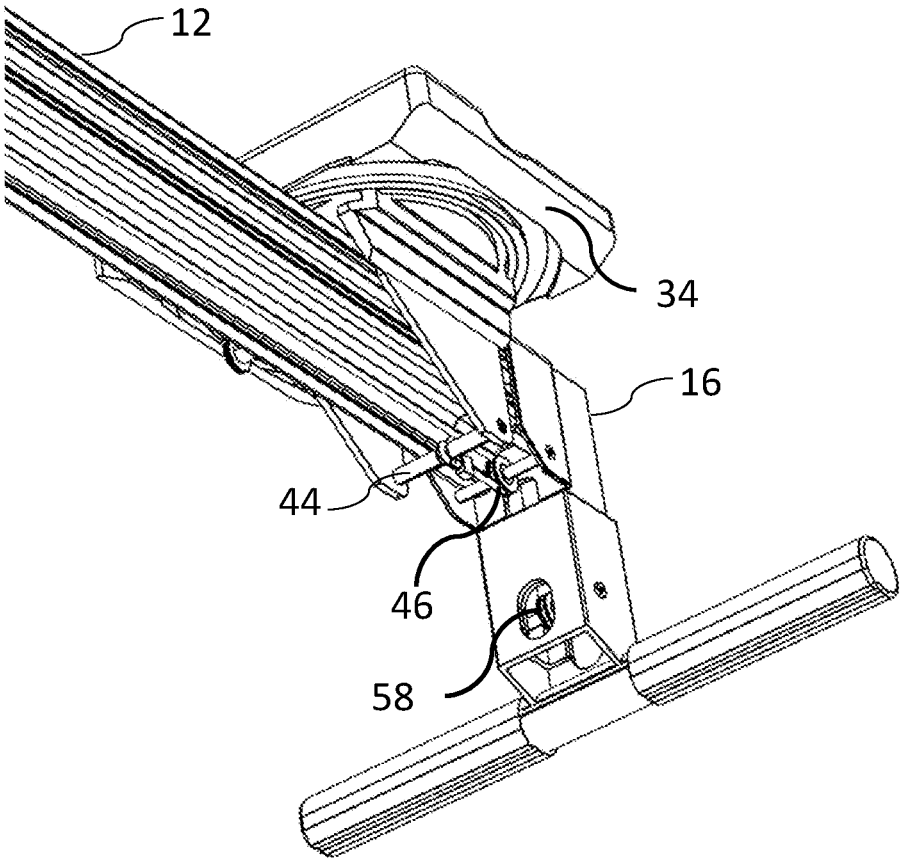
FIG. 9 is a bottom view of the slide member as in FIG. 6, according to an exemplary embodiment of the present invention.

Referring to FIGS. 6-9, on the opposite end of the rail 12 i.e., to the distal end can be mounted a slide member 34. FIG. 6 shows an enlarged perspective view of slide member 34, FIG. 7 shows the enlarged side perspective view of slide member 34, FIG. 8 is a rear view of the exercise apparatus 10, and FIG. 9 is an enlarged bottom perspective view of the slide member 34. The slide member 34 can be slidably mounted to the rail 12, such as the rail 12 can guide the movement of the slide member between the distal end and the fixed member. A suitable coupling mechanism can be used to smoothen the movement of slide member 34 over the rail 12, such as rollers or bearings can be used. Any mechanism to smoothen a horizontal slide of an object over a horizontal rail known to a skilled person can be within the scope of the present invention. Additionally, such a slide mechanism can be optional, and slide member 34 can be directly mounted on the rail 12. To hold the slide member over the rail, an elongated channel can be provided at both sides of the rail which runs along the length of the rail. The slide member can have protrusions that can be inserted into the channel and can freely slide along the length of the channel. Additionally, more than one parallel channel can be provided on each side of the rail. FIG. 1 shows two such channels spaced apart and running parallel to each other. As can be seen in FIG. 1 the rail can be rectangular or square having a top side, a bottom side, and two opposite sides. The channels can be provided on the two opposite sides of the rail. It is to be understood that the channels can also be provided on the top side and/or the bottom side without departing from the scope of the present invention.

The slide member 34 can be of a dimension to comfortably support an adult person kneeled on the slide member. The slide member can be broad enough to accommodate both legs of the user in kneeled position and preventing any risk of falling from the support member. The top surface of the slide member 34 upon which the user rest can have two depressions 36 for the two legs. In particular, the shin portion of the leg below the knee can comfortably rest within two concave shape depressions 36 on the top surface of the slide member 34. The two depressions 36 can help keep the two legs stationary on the slide member preventing any lateral movement. The depressions 36 are closed in front 38 that may prevent any forward movement of the legs and may also help the user to pull the slider forward. The top surface can be a top surface of a platform that may be titled as required in forward, rearward, and sidewards. Thus, a user can adjust the height of the fixed member and tilt the fixed member and the slide member to tailor the exercise apparatus according to his or her requirements.

Figure 10:
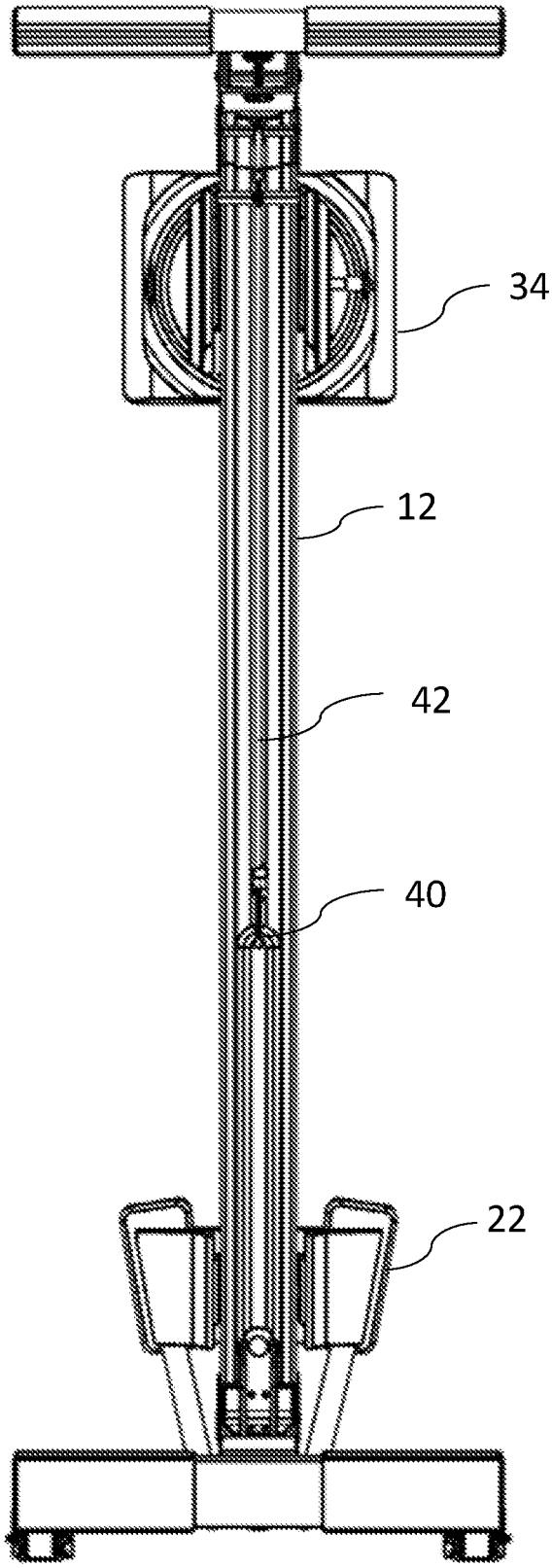
FIG. 10 is a bottom view of the exercise apparatus, according to an exemplary embodiment of the present invention.

Referring to FIG. 10, which is a bottom view of the exercise apparatus 10. The slide member can be coupled to the resistance mechanism that may oppose the forward movement of the slide member towards the fixed member. FIG. 10 shows a resistance band that may oppose that may counterforce the forward movement of the slide member. The resistance bands of variable resistances are known in the art and any such resistance band can be used without departing from the scope of the present invention. Moreover, more than one resistance band can also be interchangeably used to increase or decrease the effective resistance. Any other mechanism of increasing or decreasing the resistance of the resistance band can be used without departing from the scope of the present invention. For example, increasing the distance between the two ends of the resistance band can increase the effective resistance. The resistance band at one end can be coupled to the fixed member, or the first stanchion, or the proximal end of the rail. The other end of the resistance band can be coupled to the slide member through a cord and pulley. FIG. 10 shows cord 42 that extends from an end of the resistance band and wraps over the pulley and extends in the inverse direction, finally attached to a hook of the slide member 34. This allows the resistance band to be stretched when the slide member moves forward. FIGS. 6 and 7 show the hook 44 coupled at ends to two plates that extends downwards along the opposite sides of the rail 12. The pulley 46 can be seen in FIG. 9 coupled to the upper member of the second stanchion 16. The pulley can be coupled either to the stanchion or the distal end of rail 12. Also, can be seen in FIG. 9 is the cord 42 wrap over the pulley and extend in the inverse direction towards the hook 44.

Figure 11:
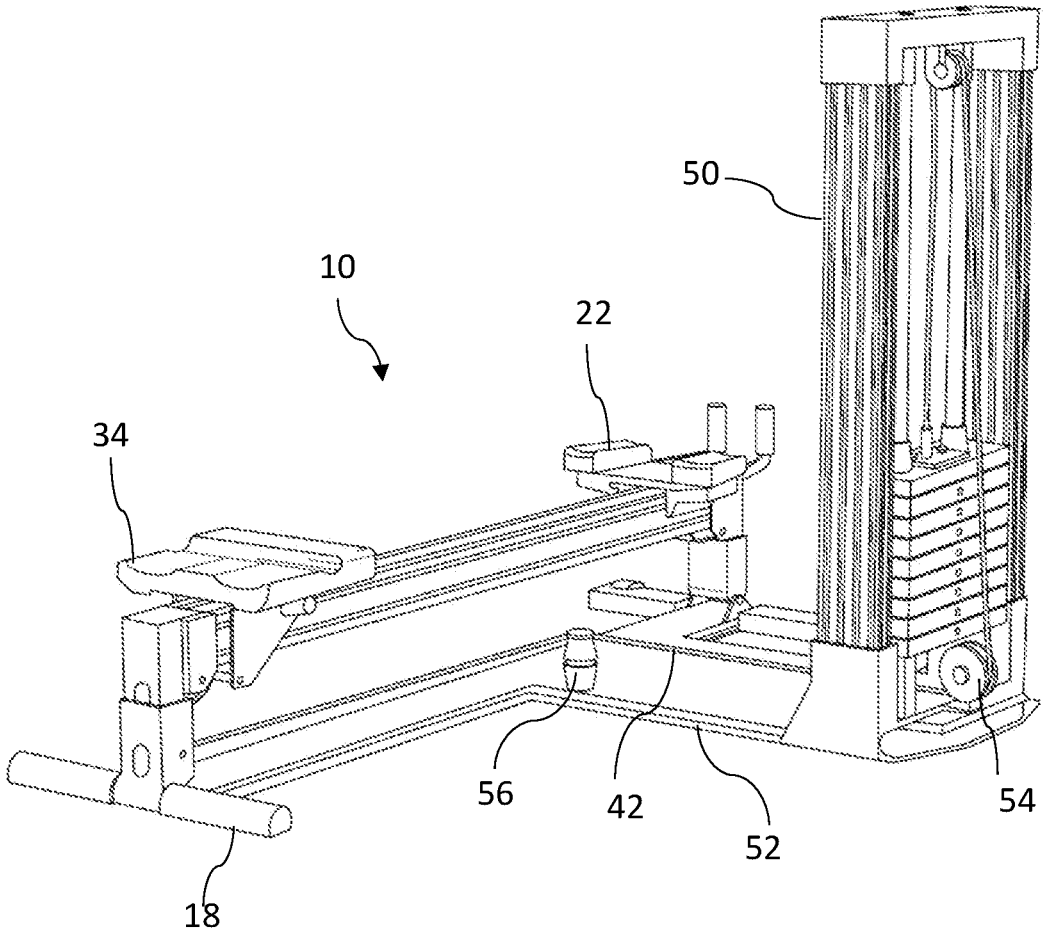
FIG. 11 is a perspective view of another exemplary embodiment of the exercise apparatus having a vertical slide weight assembly as a resistance mechanism, according to an exemplary embodiment of the present invention.

The resistance band can be replaced by any other resistance mechanism that can resist the forward movement slide member and provide desired tension for exercising the body. In one case, the resistance can be provided by a vertical slide weight assembly, as shown in FIG. 11. The structure and functioning of a vertical slide weight assembly are known to a skilled person, wherein the effective resistance can be varied by increasing or decreasing the weight bars, and such known vertical slide weight assembly with the mechanism for increasing and decreasing the weight bars can be used without departing from the scope of the present invention. The cord can be routed through the bottom of the vertical slide weight assembly by providing a pulley 54. The vertical slide weight assembly 50 can also have its frame 52 that stabilizes the vertical slide weight assembly on the floor. In one case, frame 52 of the vertical slide weight assembly 50 and frame 18 of the exercise apparatus 10 can be integral or separate. Alternatively, the vertical slide weight assembly can be mounted to frame 18 of the exercise apparatus 10, wherein frame 18 can be modified according to the position of the vertical slide weight assembly.

FIG. 11 shows the vertical slide weight assembly positioned on the side of the rail. The position of the vertical slide weight assembly relative to the exercise apparatus can be varied based on the room space and user requirements. For example, the vertical slide weight assembly can also be positioned behind the distal end of the rail and in line with the length of the rail. Such an option can be economical, however, the suitability of the arrangement may depend on the room space. The cord from the pulley 54 can then be routed to the slide member 34. Suitable diverters having the pulley can be used to route the cord if required. FIG. 11 shows a single diverter 56 then routes the cord almost perpendicularly to reach the second stanchion 16 on the distal end of the rail 12. Another pulley 58 can be provided at the lower member of the second stanchion 16. FIG. 9 shows a passage and the pulley 58 behind the passage in the lower member of the second stanchion 16. The cord can enter the passage and wraps over the pulley 58. The cord can then extend towards the pulley 46 coupled to the upper member of the second stanchion 16 which can route the cord horizontally to attach to the hook 44. FIG. 8 also shows the pulley 58 and the pulley 46, wherein the passages can be provided on both sides of the pulley i.e., the front side and the rear side. In case, the weight assembly is positioned behind the second stanchion 16, the cord can extend through the passages shown in FIG. 8.

Figure 12:
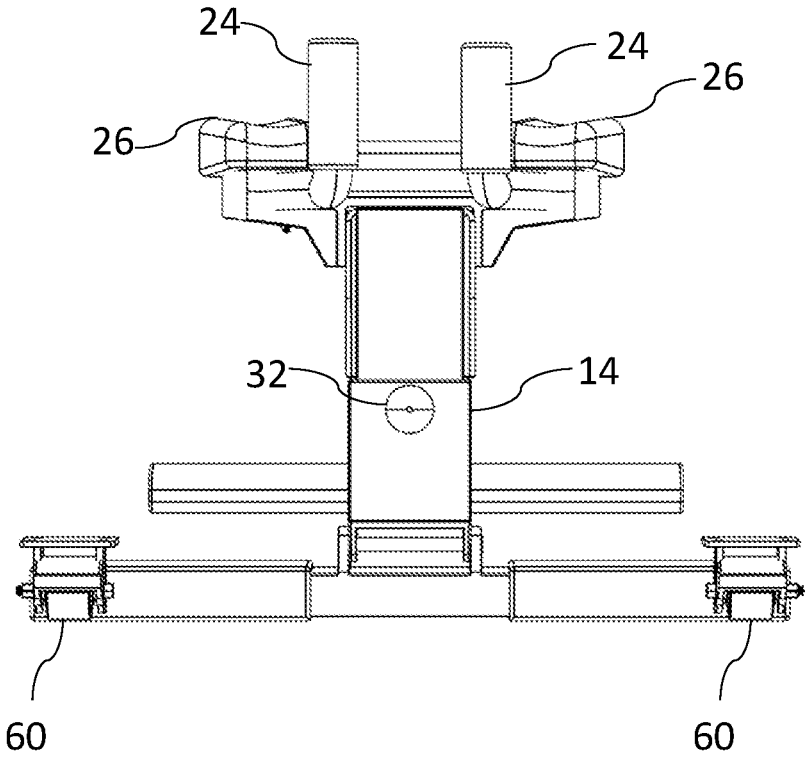
FIG. 12 is a front view of the exercise apparatus, according to an exemplary embodiment of the present invention.
Figure 13:
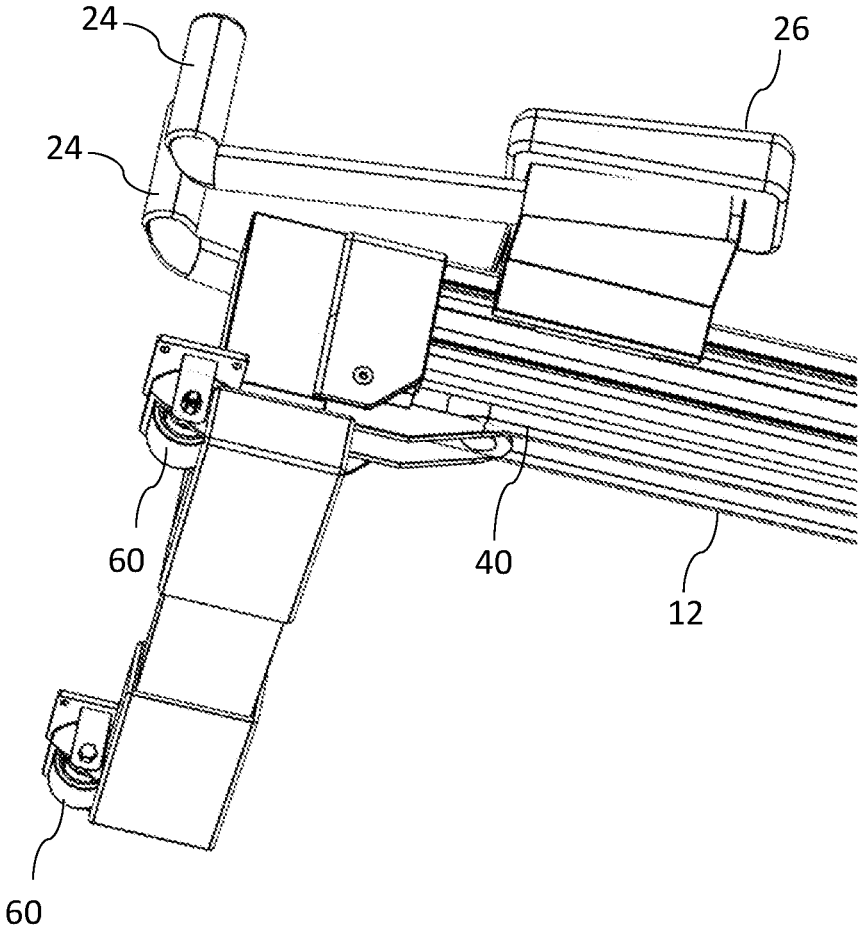
FIG. 13 is another view of the fixed member as in FIG. 5, according to an exemplary embodiment of the present invention.

Referring to FIG. 12 which shows the front view of the exercise apparatus 10 and FIG. 13 showing the bottom perspective view of the proximal end of the rail 12. The frame 18 at the end adjacent to the first stanchion 14 can have wheels 60 that may allow moving the exercise apparatus from one place to another. The exercise apparatus can be lifted from the distal end such as the frame moves upwards, and the weight is on the wheels. FIG. 7 shows a knob 62 on side of the slide member 34, wherein the knob can be used to loosen the platform 64 of the slide member. The degree of freedom of the platform can be varied, for example tilting sidewards and rotation of the platform for the desired workout.

To use the disclosed apparatus, the user can adjust the effective resistance by using an appropriate resistance band or changing the number of weight bars. Although the resistance can also be adjusted later in between the exercise. The user can then kneel on the slide member. Support for the handle can also be taken while resting down on the slide member. Once properly sited with the legs supported within the two legs supporting depressions, the user can grasp both the handles and rest his arm on the two arm supports of the fixed member. Once ready, the user can then pull the slider, using legs and the combined strength of the body, in particular the abdomen, arms, and thighs, towards the fixed member. Initially, at the distal end, the major weight of the user can be more on the slide member. Oppositely, the major weight shifts to the fixed member once the slider reaches near the fixed member. The forward movement of the slide member is resisted by the resistance mechanism, thus, the user must apply force against the counterforce of effective resistance. Once, the forward travel is complete, the user can return to the distal end. While returning the slide member is pulled by the potential energy stored in the resistance mechanism during the forward run of the slide member and the user may apply strength against the pull force of the resistance mechanism to effectively slow down the return speed. This to-and-fro motion between the distal end and the fixed member can be repeated the desired number of times.

Figure 14:
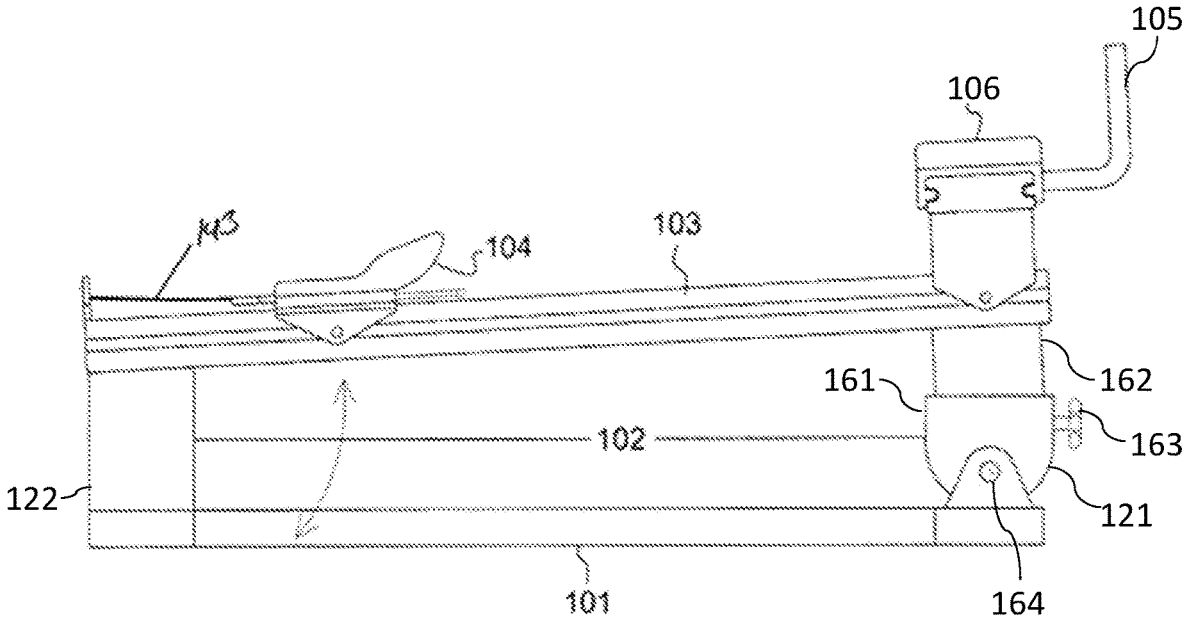
FIG. 14 is a side view of another exemplary embodiment of the exercise apparatus, according to an exemplary embodiment of the present invention.

Referring to FIGS. 14 and 15 which shows another exemplary embodiment of the disclosed exercise apparatus.

The exercise apparatus 100 includes a pedestal 101, two stanchions 102, a rail 103, a slider 104, two handles 105, and arm support 106. The pedestal 101 can be formed from multiple prism structures in an I-shaped structure. Each of the two stanchions 102 is a vertically oriented structure that elevates the slider 104 rail 103 above the floor. The two stanchions 102 are adjustable such that the cant of the slider 104 the rail 103 relative to the force of gravity can be adjustable. The two stanchions 102 includes an anterior stanchion 121 and a posterior stanchion 122. The anterior stanchion 121 can be a composite prism structure.

The anterior stanchion 121 can be a telescopic structure. The anterior stanchion 121 can be an adjustable structure such that the span of the center axis of the composite prism structure of the anterior stanchion 121 can be adjustable. The cant of the center axis of the prism structure of the slider 104 and the rail 103 can be adjusted by adjusting the span of the length of the center axis of the anterior stanchion 121.

The anterior stanchion 121 can have an upper member 162 and a lower member 161, wherein the members can be telescopically coupled to each other. The length of the anterior stanchion 121 can be adjusted by adjusting the relative position of the upper member relative to the lower member. A detent 163, such as a cotter pin, a G snap collar, a cam lock collar, a threaded clutch, a split collar lock, or a spring-loaded ball lock can be used to lock the two members. The anterior stanchion 121 can be mounted to the pedestal 101 through a rotating structure 164. A cord 143 attached the slider to a weight assembly for resistance. The cord 143 can be an inelastic structure, such as metal, nylon, or like wire.

The platform of slider 104 can be coupled through a slewing bearing such as the slider can rotate around a vertically oriented axis of rotation. The slewing bearing may allow the platform to rotate horizontally to form a cant relative to the center axis of the slider 104.

The rotation of the platform allows the exercise apparatus 100 to be used for oblique physical training activities. The slewing bearing can be a spring-loaded structure that realigns the platform of the slider to the center axis of the slider and the rail when the slewing bearing returns to its relaxed shape. The slewing bearing can also be a locking structure that may allow to temporarily fix the position of the cant of the platform relative to the center axis of the rail 103. The handles can be seen upstanding perpendicularly to the length of the rail 103.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. An exercise apparatus comprising:

a horizontal rail having a proximal end and a distal end;

a front vertical support coupled to the proximal end of the rail and configured to support the proximal end at a first height;

a rear vertical support coupled to the distal end of the rail and configured to support the distal end at a second height;

a fixed member coupled to the proximal end of the rail, the fixed member comprises:

a pair of handles, and an arm support, wherein the pair of handles and the arm support are positioned such as a user having his arms rested on the arm support can grasp the pair of handles while the arms and hands of the user remain straight;

a slide member slidably coupled to the rail, wherein the slide member and the rail are configured such as the rail guides movement of the slide member between the distal end and the fixed member, the slide member having a platform, wherein the platform is configured such as the user can kneel on the platform; and a resistance mechanism coupled to the slide member and configured to provide a predetermined amount of resistance to a forward movement of the slide member towards the fixed member, wherein the slide member, the rail, and the fixed member are configured:

to support the user in an exercise position having the user kneeled on the slide member grasping the pair of handles and having the arms resting on the arm support, and the user in the exercise position can pull the slide member towards the fixed member against the resistance, wherein the slide member further comprises a hook, the exercise apparatus further comprises a first pulley coupled to the rear vertical support, wherein the hook is positioned below the rail and mounted to a pair of parallel plates that extends downwards along opposite sides of the rail.

2. The exercise apparatus according to claim 1, wherein the first height is equal to the second height.

3. The exercise apparatus according to claim 1, wherein the first height is greater than the second height.

4. The exercise apparatus according to claim 1, wherein the front vertical support comprises a length adjustment mechanism to increase or decrease the first height.

5. The exercise apparatus according to claim 4, wherein the fixed member is further configured to tilt in a forward and rearwards direction.

6. The exercise apparatus according to claim 1, wherein the front vertical support comprises an upper member and a lower member, the upper member and the lower member are adjacent and configure to telescopically move relative to each other.

7. The exercise apparatus according to claim 1, wherein the rear vertical support comprises a length adjustment mechanism to increase or decrease the second height.

8. The exercise apparatus according to claim 1, wherein a top surface of the arm support comprises two concave arm depressions, wherein each arm depression is configured such as an arm of the user rests in the arm depression and the arm depression prevents lateral movement of the arm.

9. The exercise apparatus according to claim 8, wherein the arm support comprises two spaced arm supports, wherein each of the two spaced arm supports has one arm depression of the two concave arm depressions.

10. The exercise apparatus according to claim 8, wherein a top surface of the platform of the slide member comprises two concave leg depressions, wherein each leg depression is configured such as a shin portion of a leg below the knee can rest in the leg depression and the leg depression prevents lateral movement of the leg.

11. The exercise apparatus according to claim 10, wherein a front of each of the two leg depressions having a barrier to limit a forward movement of the leg.

12. The exercise apparatus according to claim 1, wherein the slide member is configured such as the platform rotates clockwise and anticlockwise, wherein the slide member further comprises a lock mechanism to limit the rotation.

13. The exercise apparatus according to claim 1, wherein the resistance mechanism is a resistance band of predetermined resistance, the resistance band having a proximal end and a distal end, the proximal end of the resistance band coupled to the fixed member, a cord connects the distal end of the resistance band to the hook.

14. The exercise apparatus according to claim 13, wherein the cord extends from the distal end of the resistance band, thereafter, wraps over the first pulley and then extends in an inverse direction for horizontally attaching to the hook.

15. The exercise apparatus comprising:

a horizontal rail having a proximal end and a distal end;

a front vertical support coupled to the proximal end of the rail and configured to support the proximal end at a first height;

a rear vertical support coupled to the distal end of the rail and configured to support the distal end at a second height;

a fixed member coupled to the proximal end of the rail, the fixed member comprises:

a pair of handles, and an arm support, wherein the pair of handles and the arm support are positioned such as a user having his arms rested on the arm support can grasp the pair of handles while the arms and hands of the user remain straight;

a slide member slidably coupled to the rail, wherein the slide member and the rail are configured such as the rail guides movement of the slide member between the distal end and the fixed member, the slide member having a platform, wherein the platform is configured such as the user can kneel on the platform; and a resistance mechanism coupled to the slide member and configured to provide a predetermined amount of resistance to a forward movement of the slide member towards the fixed member, wherein the slide member, the rail, and the fixed member are configured:

to support the user in an exercise position having the user kneeled on the slide member grasping the pair of handles and having the arms resting on the arm support, and the user in the exercise position can pull the slide member towards the fixed member against the resistance, wherein the slide member further comprises a hook, the exercise apparatus further comprises a first pulley coupled to the rear vertical support, wherein the resistance mechanism is a vertical slide weight assembly, a cord connects the weights of the vertical slide weight assembly to the hook.

16. The exercise apparatus according to claim 15, wherein the vertical slide weight assembly is positioned on either side of the rail, the exercise apparatus further comprises one or more diverters each having a pulley for routing the cord from the vertical slide weight assembly to the hook.

17. An exercise apparatus comprising:

a horizontal rail having a proximal end and a distal end;

a front vertical support coupled to the proximal end of the rail and configured to support the proximal end at a first height;

a rear vertical support coupled to the distal end of the rail and configured to support the distal end at a second height;

a fixed member coupled to the proximal end of the rail, the fixed member comprises:

a pair of handles, and an arm support, wherein the pair of handles and the arm support are positioned such as a user having his arms rested on the arm support can grasp the pair of handles while the arms and hands of the user remain straight;

a slide member slidably coupled to the rail, wherein the slide member and the rail are configured such as the rail guides movement of the slide member between the distal end and the fixed member, the slide member having a platform, wherein the platform is configured such as the user can kneel on the platform; and a resistance mechanism coupled to the slide member and configured to provide a predetermined amount of resistance to a forward movement of the slide member towards the fixed member, wherein the slide member, the rail, and the fixed member are configured:

to support the user in an exercise position having the user kneeled on the slide member grasping the pair of handles and having the arms resting on the arm support, and the user in the exercise position can pull the slide member towards the fixed member against the resistance, wherein the exercise apparatus further comprises a telescoping mechanism for increasing and decreasing a height of the fixed member relative to the rail, wherein the front vertical support comprises a length adjustment mechanism to increase or decrease the first height independent of the second height.

18. The exercise apparatus according to claim 17, wherein a top surface of the platform of the slide member comprises two concave leg depressions, wherein each leg depression is configured such as a shin portion of a leg below the knee can rest in the leg depression and the leg depression prevents lateral movement of the leg, and a front of each of the two leg depressions having a barrier to limit a forward movement of the leg.

19. The exercise apparatus according to claim 17, wherein the fixed member is configured to be tilted forwards and rearwards.

20. The exercise apparatus according to claim 17, wherein the slider is configured to be tilted left and right sides for oblique physical training.

* * * * *